United States Patent [19]

Guitay

[11] Patent Number: 4,883,047

[45] Date of Patent: Nov. 28, 1989

[54] APPARATUS FOR MASSAGING THE HUMAN BODY

[76] Inventor: Louis P. Guitay, 1 avenue Victor Hugo, 26000 Valence, France

[21] Appl. No.: 168,972

[22] Filed: Mar. 16, 1988

[30] Foreign Application Priority Data

Mar. 17, 1987 [FR] France ..... 87 03865

[51] Int. Cl.[4] ..... A61H 1/00

[52] U.S. Cl. ..... 128/38; 128/57

[58] Field of Search ..... 128/38, 57, 56, 60, 128/62, 67, 44

[56] References Cited

U.S. PATENT DOCUMENTS

| | | | |
|---|---|---|---|
| 1,663,167 | 3/1928 | Koester | 128/57 |
| 1,663,975 | 3/1928 | David | 128/57 |
| 1,840,796 | 1/1932 | Schweers | 128/57 |
| 2,248,525 | 7/1941 | Fleissner | 128/57 |
| 2,369,544 | 2/1945 | Dolan | 128/57 |
| 2,574,601 | 11/1951 | Swanson | 128/38 |
| 2,819,715 | 1/1958 | Calhoun | 128/57 |
| 3,297,024 | 1/1967 | Robinson | 128/38 |
| 4,416,271 | 11/1983 | Chester | 128/57 |
| 4,729,368 | 3/1988 | Guitay | 128/57 |
| 4,744,350 | 5/1988 | Sato | 128/57 |

FOREIGN PATENT DOCUMENTS

| | | | |
|---|---|---|---|
| 3401522 | 7/1985 | Fed. Rep. of Germany . | |
| 409202 | 4/1910 | France . | |
| 1235695 | 5/1960 | France | 128/57 |
| 2579100 | 9/1966 | France . | |
| 2589726 | 5/1987 | France . | |
| 168279 | 6/1934 | Switzerland . | |

*Primary Examiner*—Edgar S. Burr
*Assistant Examiner*—Huong Q. Pham
*Attorney, Agent, or Firm*—Wall and Roehrig

[57] ABSTRACT

A massage tool has two parallel rollers mounted for free rotation in a manually operated housing, which is connected to a suitable vacuum source to create a vacuum in the space above the rollers. The two active rollers are mounted at a fixed distance between axes, the rollers being supported between two parallel walls at the lower or distal part of the housing. The walls define a chamber which is substantially the same height as the diameter of the rollers. The latter form a tangent substantially at a roof of the chamber, but there is a small clearance—a few hundredths of a millimeter—to permit rotation. The rollers project slightly beyond the lower or distal ends of the walls. The vacuum conduit is flared out somewhat at the roof of the chamber to spread evenly over the area between the rollers.

4 Claims, 1 Drawing Sheet

APPARATUS FOR MASSAGING THE HUMAN BODY

FIELD OF THE INVENTION

The present invention relates to an improved apparatus for massaging all parts of the human body.

BACKGROUND OF THE INVENTION

Various massaging tecnhiques are used as a function of the treatments to be undergone. In general, massaging operations involve subjecting the patient to stresses such as pressure, and/or displacements and/or pinchings.

Various types of equipment have been proposed up to now to simplify the work of physiotherapists, such as for example by Swiss Pat. No. 168279 and by U.S. Pat. No. 3,297,024. In general such equipment exerts on the body an action of pressure, of displacement, of friction by vibrations, suction, etc.

Recently, in French Patent Applications Nos. 85 04 245 (Publication No. 2 579 100) and 85 17 026 (Publication No. 2 589 726), the letter corresponding to U.S. patent application No. 4,729,368, the Applicant has proposed improved massage apparatus for carrying out, simply and efficiently, "rolled palpation" type massages in which the patient is subjected to a continuous action which causes not only a localized pinching but also a progressive displacement of the pinched zone so as to cause a "roll", and this while exerting a pressure. In general, the apparatus described in said patent applications are essentially constituted of two rollers mounted in a housing according to parallel axes, the periphery of the rollers drawing a tangent with the lower face of the housing, one of the rollers being preferably driven positively in rotation, and said housing being connected with means for creating a vacuum above said rollers.

In order to pinch the skin, said rollers are mounted in the housing in such a way that they can be moved apart or closer to each other so as to perform a pinching action on the formed fold of skin.

Said apparatus give very good results, nevertheless they imply the use of means for achieving tightness during the displacements of rollers.

SUMMARY OF THE INVENTION

A simplified device has now been found, and this is the object of the present invention, which makes it possible to perform such massages without the need to move the treatment rollers apart or closer together, hence eliminating any additional means for achieving tightness such as valves or pivoting flaps.

Such a solution is particularly adaptable to the production of small-sized apparatus but, this is not in any way restrictive.

In general, the invention relates to an improvement in massaging apparatus of the type comprising two parallel rollers mounted for free rotation in a manually operated housing which is connected to means for creating a vacuum above the rollers. The apparatus of this invention has the following special features:

the two active rollers are maintained in spaced apart relatinship between two parallel walls provided at the lower part of the housing, said walls defining a chamber, the height of which is such as to correspond substantially to the diameter of the rollers, so that the latter draw a tangent with the bottom of said chamber, a slight play being left to allow their rotation, and said rollers preferably projecting slightly beyond the lower edges of said walls;

the vacuum created inside the housing is obtained via a conduit issuing into the space between the rollers; said conduit being of circular cross-section and preferably widening out where it issues inside the chamber.

Advantageously, in practice:

the distance between the rollers is substantially equal to the diameter of said rollers;

said rollers are removably mounted inside the chamber, in order to allow cleaning;

the assembly consisting of the housing containing the rollers and of the handle for actuating the apparatus is monoblock, i.e., unitarily molded or cast, the suction conduit pipe provided inside the handle being equipped at its end with a fitting for connecting the apparatus with a suction source such as for example the outlet of a conventional household vacuum-cleaner, a source of vacuum such as provided in hospitals, or the like

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
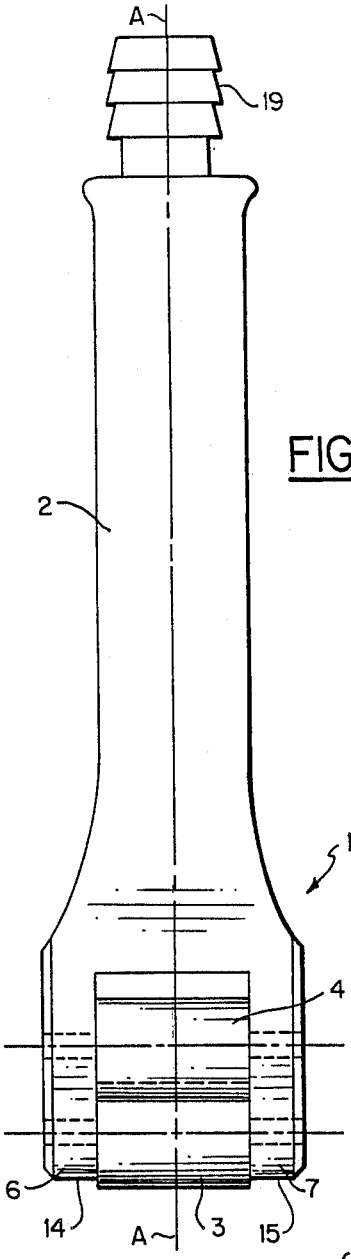
FIG. 1 is an elevational view of an apparatus according to the invention.

Referring now to the drawings, the massaging apparatus according to the invention is in the form of an assembly constituted essentially by a housing (or head) designated by general reference (1) and on which are mounted the massaging rollers, said housing (1) being extended by a handle (2). In the illustrated example, the housing (1) and the handle (2) form a monobloc assembly and are obtained for example by unitarily molding a plastic material. It is understood that the handle (2) could also be a separate piece attached to the housing (1).

Figure 3:
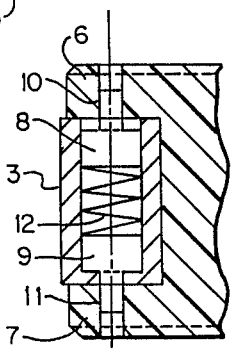
FIG. 3 is a cross-section along axis BB of FIG. 2 showing how the active rollers are mounted inside the treating head.

According to the invention, the rollers (3,4) are mounted at the base of the housing (1), inside a chamber (5) formed by two parallel side walls (6,7), with a fixed distance E between their axes, the spacing of rollers (3,4) being adaptable as a function of the zones to be massaged but being in general substantially equal to the diameter of said rollers. Preferably, the rollers (3,4) are mounted inside the chamber (5) in such a way as to be readily removable and replaceable for cleaning the massaging head. The detailed view shown in FIG. 3 illustrates one embodiment of such a removable mounting. According to this embodiment, roller (3) (roller (4) being mounted in the same way) is hollow and is mounted on the two wall (6,7) via pins (8,9) fitting in bearings (10,11) provided on the walls (6,7), both pins (8,9) being subjected to the action of an internal spring (12). As a result, the roller (3) (or 4) can pivot freely between the bearings (10,11). Removal of the rollers is effected by pushing the two pins (8,9) against each other, for example with pliers, in such a way as to compress the spring (12), this permitting the release of the whole assembly. Another solution for mounting the rollers (3,4) between the two side walls (6,7) consists simply in providing grooves on said side walls to allow the passage of the ends of the pins of said rolls, fastening being achieved with clips. It is understood that any other suitable mounting means could also be used.

Rollers (3,4) are mounted inside the chamber (5) in such a way that their periphery can draw a tangent with the inner face or roof (13) of the chamber, a slight play or clearance (of about a few hundredths of a millimeter) being however provided to allow the free rotation of the rollers (3,4). Moreover, the two rollers (3,4) slightly project of a few tenths of a millimeter, beyond the lower or distal edges (14,15) of side walls (6,7) of the chamber (5).

Figure 2:
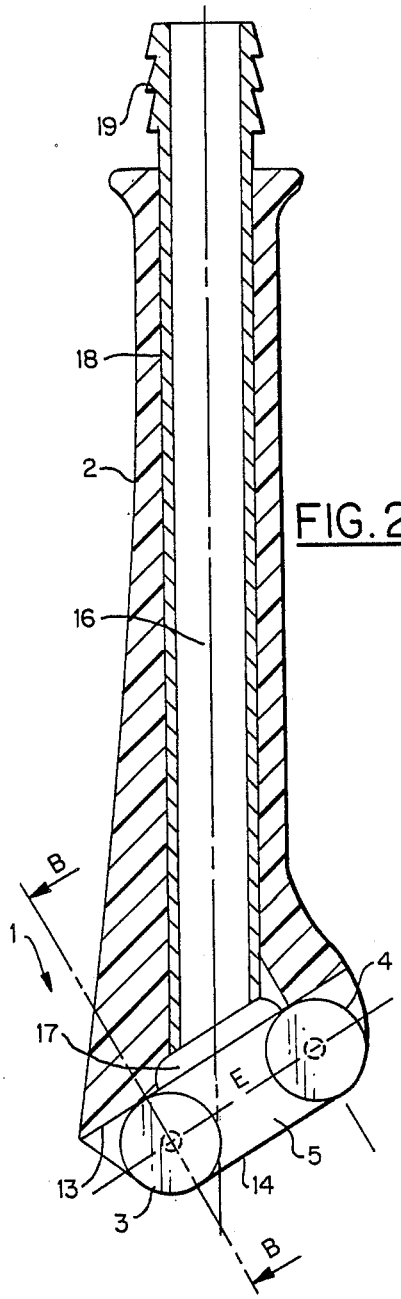
FIG. 2 is a cross-section along axis AA of FIG. 1 illustrating in detail the structure of an apparatus according to the invention.

Conveniently, a conduit 16 issues into the space provided between the two rollers (3,4), the proximal end (19) of which conduit is in the form of a fitting which can be connected to a suction source (not shown). Said conduit (16) is preferably constituted by a tubular insert (18) introduced into the body (2) of the apparatus. Preferably, said conduit (16) ends into a chamber (17) which can have a widening out shape, and which spreads over the entire space between the rollers. As shown in FIG. 2 the handle (2) projects proximally along a straight line that forms a small angle from the normal through the plane of the two rollers (3,4).

The use of such a massaging apparatus is very simple. Indeed, by simple application of the lower face of the treatment chamber, the skin, under the suction produced inside the conduit, forms a fold between the rollers (3,4), said fold being massaged over by the manipulator who, by moving the apparatus, causes the rotation of rollers (3,4).

Obviously, the invention is not limited to the embodiment described hereinabove and on the contrary covers any modifications that can be brought thereto without departing from its scope. For example, the apparatus could be equipped with means of varying the vacuum created between the rollers as a function of the treatments to be dispensed.

What is claimed is:

1. Massaging apparatus of the type in which a pair of parallel rollers of a predetermined diameter are mounted for free rotation in a manually operated housing, the latter being connected to means for creating a vacuum above the rollers wherein the housing includes two parallel walls at a distal end which support the pair of rollers therebetween, the rollers being mounted at a fixed separation therebetween, the housing also having a roof which, with the parallel walls and the rollers, defines a chamber whose height corresponds substantially to the diameter of the rollers, and in which a conduit connects said vacuum creating means to said chamber; comprising the improvement wherein said rollers project slightly beyond the parallel walls and the rollers have a tangent that lies substantially along the roof of said chamber but with a small clearance on the order of a few hundredths of a millimeter being provided between the periphery of two rollers and the roof of the chamber to permit rotation of the rollers, said clearance alone constituting the only vacuum sealing means between the roof of the chamber and the periphery of the rollers, and said vacuum conduit flares out at the roof of the chamber to spread over substantially the entire space between the rollers, wherein there is a fixed radial spacing between the periphery of the rollers that is substantially equal to the diameter of the rollers.

2. Apparatus as defined in claim 1 wherein said rollers include drop out means for removably mounting said rollers at fixed locations in said chamber.

3. Apparatus as defined in claim 1 wherein said housing is unitarily formed with an operating handle that projects proximally away from said roof of said chamber, and said vacuum conduit extends from said chamber, through said handle and out a proximal end thereof, with fitting means thereon proximally of said handle for connecting to said vacuum creating means.

4. Apparatus as defined in claim 3 wherein said handle projects substantially straight along an axis that is at a small angle from the normal through said roof of said chamber.

* * * * *